US008248433B2

(12) United States Patent
Young

(10) Patent No.: US 8,248,433 B2
(45) Date of Patent: Aug. 21, 2012

(54) ERROR ACCUMULATION DITHERING OF IMAGE DATA

(75) Inventor: Wayne D. Young, Milpitas, CA (US)

(73) Assignee: NVIDIA Corporation, Santa Clara, CA (US)

( * ) Notice: Subject to any disclaimer, the term of this patent is extended or adjusted under 35 U.S.C. 154(b) by 2355 days.

(21) Appl. No.: 10/796,695

(22) Filed: Mar. 8, 2004

(65) Prior Publication Data

US 2005/0210338 A1 Sep. 22, 2005

(51) Int. Cl.
*G09G 5/02* (2006.01)

(52) U.S. Cl. ..... 345/598

(58) Field of Classification Search ..... None
See application file for complete search history.

(56) References Cited

U.S. PATENT DOCUMENTS

| | | | |
|---|---|---|---|
| 5,175,807 | A | 12/1992 | Cawley et al. |
| 6,057,933 | A | 5/2000 | Hudson et al. |
| 2003/0025700 | A1 | 2/2003 | Sasaki et al. |
| 2003/0122847 | A1 | 7/2003 | Donovan et al. |

FOREIGN PATENT DOCUMENTS

| | | |
|---|---|---|
| JP | 2001 092405 | 4/2001 |

OTHER PUBLICATIONS

Fawcett at al., "Halftoning Techniques Using Error Correction," Proceedings of the SID 27 (4) 305-308 (1986).
Paul Heckbert, "Color Image Quantization for Frame-Buffer Display," Computer Graphics vol. 16, No. 3 (Jul. 1982), pp. 297-307.
Floyd, Robert et al., "4.3: An Adaptive Algorithm for Spatial Grey Scale," Society for Information Display, 1975 Symposium Digest of Technical Papers (1975), pp. 36-37.

*Primary Examiner* — Aaron M Richer
(74) *Attorney, Agent, or Firm* — Kilpatrick Townsend & Stockton LLP

(57) ABSTRACT

Error accumulation dithering is used to generate images of lower color resolution from input data of higher color resolution. A target color is received at high resolution for a current pixel of the image. The target color is intermediate between a first color and a second color at a low color resolution. One of the first color and the second color is selected as a final pixel color, based on whether an accumulated error determined from previous pixels is above or below a threshold amount. After selecting the final pixel color, an updated accumulated error is provided to the next pixel.

18 Claims, 6 Drawing Sheets

ERROR ACCUMULATION DITHERING OF IMAGE DATA

BACKGROUND OF THE INVENTION

The present invention relates in general to raster-based image generation and in particular to systems and methods for dithering of image data based on error accumulation.

Modern graphics processing systems generate pixel data at high color resolution. For instance, a color resolution of 24 bits (8 bits in each red, green, and blue color component) is commonly used. In some cases, the color resolution available in the graphics processing system can exceed the color resolution available (or in use) on a particular display device. For example, some LCD devices use 18-bit color (6 bits in each color component), making fewer colors available.

Color dithering is often used to create the appearance of a larger number of colors than a given display device provides. For instance, if a region within the image is to be displayed at a color intermediate in intensity between two available colors, the appearance of the intermediate color can be created by displaying some of the pixels at the lower intensity color and some at the higher intensity color. For example, suppose that some area of an image is supposed to have a color (or color component) $C_0$ whose intensity is intermediate between a lower available value $C_L$ and a higher available value $C_H$. For an N*N block of pixels, there is an integer "mixing factor" P that most nearly satisfies the equation:

$$C_0=C_H*P/N^2+C_L*(N^2-P)/N^2.$$

The desired color $C_0$ can be approximated by setting the color value for P of the N*N pixels to the higher value $C_H$, and the color value for the rest of the pixels to the lower value $C_L$. The selection of which P pixels to set to the higher value $C_H$ is often made by applying an N*N "dither matrix" to each pixel block on the screen. The entries in the dither matrix, each corresponding to a different pixel, typically consist of the numbers from 0 to $N^2-1$, arranged in a pattern such that the desired color effect is produced by setting the color to $C_H$ for pixels whose dither matrix entry is less than P and to $C_L$ for the remaining pixels. The dither matrix is repeated for each N*N block of pixels in the display, with a typical value of N being 4. This dithering procedure is usually applied separately to each color component.

Matrix-based dithering, however, can produce undesirable artifacts in the displayed image. For example, due to the repetition of the dither matrix for each block of pixels, a visible "screen door" effect can occur as similar patterns of bright and dark pixels tend to recur in horizontal and vertical bands across the image. Some implementations attempt to avoid this by rearranging the entries in the dither matrix on successive frames (e.g., in a 4-frame cycle for a 4×4 dither matrix), thereby blurring the temporal resolution. However, the cycle is often slow enough to produce visible scintillation or flickering effects.

As an alternative to a fixed dither matrix, Floyd and Steinberg have proposed a dithering algorithm based on error forwarding from pixels earlier in the scanout order to later scanned neighbors. This algorithm is illustrated in FIG. 1 for a 3×3 block of pixels 100. Pixels 110-118 are scanned in raster order (across rows, starting at the top). The display color ($C_D$) of pixel 114 is determined based on the desired color for that pixel ($C_0$) plus an error term $\epsilon$ accumulated from respective error terms $\epsilon_0$ to $\epsilon_3$ of previously scanned neighbor pixels 110-113. For example, if $C_0+\epsilon \geqq C_H$, then $C_H$ is chosen as the displayed color $C_D$, otherwise $C_L$ is chosen. A residual error $\epsilon_4$ (e.g., $C_0$-$C_D$) is then determined and forwarded to the unscanned neighbor pixels 115-118 as shown. The forwarded error is distributed unequally among the unscanned neighbors; e.g., 7/16 of $\epsilon_4$ is forwarded to pixel 115, while only 1/16 of $\epsilon_4$ is forwarded to pixel 116. The same distribution pattern is used for each pixel. Because each pixel is a neighbor of several others, the error for a given pixel is the sum of errors from previously scanned neighbors. For example, the error term $\epsilon$ used to determine the color of pixel 114 would be:

$$\epsilon=(3/16)*\epsilon_0+(5/16)*\epsilon_1+(1/16)*\epsilon_2+(7/16)*\epsilon_3,$$

where $\epsilon_0$ to $\epsilon_3$ are the respective residual errors for pixels 110-113. As with matrix-based dithering, R, G, and B color components can be processed independently using this procedure. This technique results in a distribution of higher-intensity ($C_H$) pixels among lower-intensity ($C_L$) pixels to produce the desired visual effect, and the error distribution introduces quasi-random variation that can reduce or eliminate the undesired screen door effect.

Such an error distribution algorithm, however, is expensive to implement in hardware. For instance, a line store is generally needed to keep track of errors to be added to each pixel in the next row while processing a current row, and frequent read-modify-write operations on the line store are required to accumulate the errors from all neighbor pixels.

It would therefore be desirable to provide a dithering technique that avoids screen door effects or other visual artifacts while still being inexpensive to implement.

BRIEF SUMMARY OF THE INVENTION

Embodiments of the present invention provide error accumulation dithering for use in generating images of lower color resolution from input image data of higher color resolution. In accordance with an embodiment of the invention, when data for the high color resolution image specifies a color for a pixel that is intermediate between two of the low resolution colors, selection between the two colors for a given pixel is controlled by an error term accumulated from previously processed pixels.

According to one aspect of the present invention, a method of dithering an image is provided. A target color is received at a high color resolution for a current one of a number of pixels of the image. The target color is intermediate between a first color and a second color at a low color resolution. An accumulated error is tracked across the pixels up to and including the current pixel. One of the first color and the second color is selected as a final pixel color, with the first color being selected in the event that the accumulated error is less than a threshold and the second color being selected in the event that the accumulated error exceeds the threshold; the accumulated error is reduced below the threshold in the event that the second color is selected. An updated accumulated error is provided to a next one of the pixels.

In some embodiments, the act of tracking the accumulated error may include determining a current error based on a difference between the first color and the target color and adding the current error to the accumulated error. The accumulated error may be reduced by an amount corresponding to the threshold in the event that the second color is selected.

In other embodiments, the act of selecting the final pixel color may include adding the accumulated error to the target color, thereby obtaining a modified target color; selecting the first color as the final pixel color in the event that the modified target color is intermediate between the first color and the second color; and selecting the second color as the final pixel color in the event that the modified target color is not intermediate between the first color and the second color. The difference between the modified target color and the final pixel color may be stored as an updated accumulated error that can be provided to the next pixel.

According to another aspect of the present invention, a device for dithering an image includes an accumulator module, a conversion module, and an adjustment module. The accumulator module is configured to track an accumulated error across a number of pixels of the image. The conversion module is configured to receive a high resolution color signal for a current pixel of the image and to generate a corresponding low resolution color signal. The adjustment module is configured to modify the low resolution color signal for the current pixel in the event that the accumulated error exceeds a threshold. After processing the current pixel, the accumulated error is provided to a next one of the pixels.

In some embodiments, the accumulator module may include a current error circuit and a first adder circuit. The current error circuit may be configured to extract a current error from the high resolution color signal for the current pixel, and the first adder circuit may be configured to add the current error to the accumulated error and to provide an updated accumulated error to the adjustment module. The adjustment module may include a comparator circuit and a second adder circuit, with the comparator circuit being configured to compare the updated accumulated error to a threshold, thereby generating a dither control signal and the second adder circuit being configured to receive the low resolution color signal from the conversion module and to adjust the received low resolution color signal based on the dither control signal, thereby generating a final color signal.

In other embodiments, the accumulator module may include a register configured to store the accumulated error; the adjustment circuit may include an adder circuit configured to add the accumulated error to the high resolution color signal, thereby generating an intermediate color signal; and the conversion circuit may include a truncator circuit configured to reduce the intermediate color signal to a low resolution color signal. This truncator circuit may be further configured to reduce the intermediate color signal by removing a number of least significant bits and to store the removed least significant bits in the register as a new accumulated error.

The following detailed description together with the accompanying drawings will provide a better understanding of the nature and advantages of the present invention.

DETAILED DESCRIPTION OF THE INVENTION

Embodiments of the present invention provide error accumulation dithering for use in generating images of lower color resolution from input image data of higher color resolution. "Color resolution" (or "resolution") as used herein refers generally to the number of distinct colors that can be specified for a pixel of an image, and the term may be applied to an overall color or to a particular component thereof, such as a single RGB component. In some embodiments, colors are represented by values, and the number of such values (which may depend, e.g., on the number of bits used to represent the value) determines the color resolution. In accordance with an embodiment of the invention, when data for the high resolution image specifies a color for a pixel that is intermediate between two low resolution colors, selection between the two low resolution colors for a given pixel is based on an error term accumulated from previously processed pixels.

Figure 1:
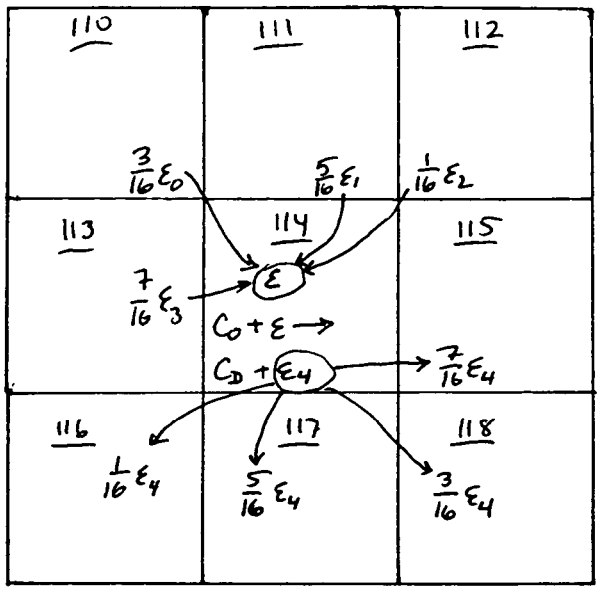
FIG. 1 (PRIOR ART)
FIG. 1 illustrates a conventional error distribution dithering scheme for a 3×3 block of pixels.
Figure 2:
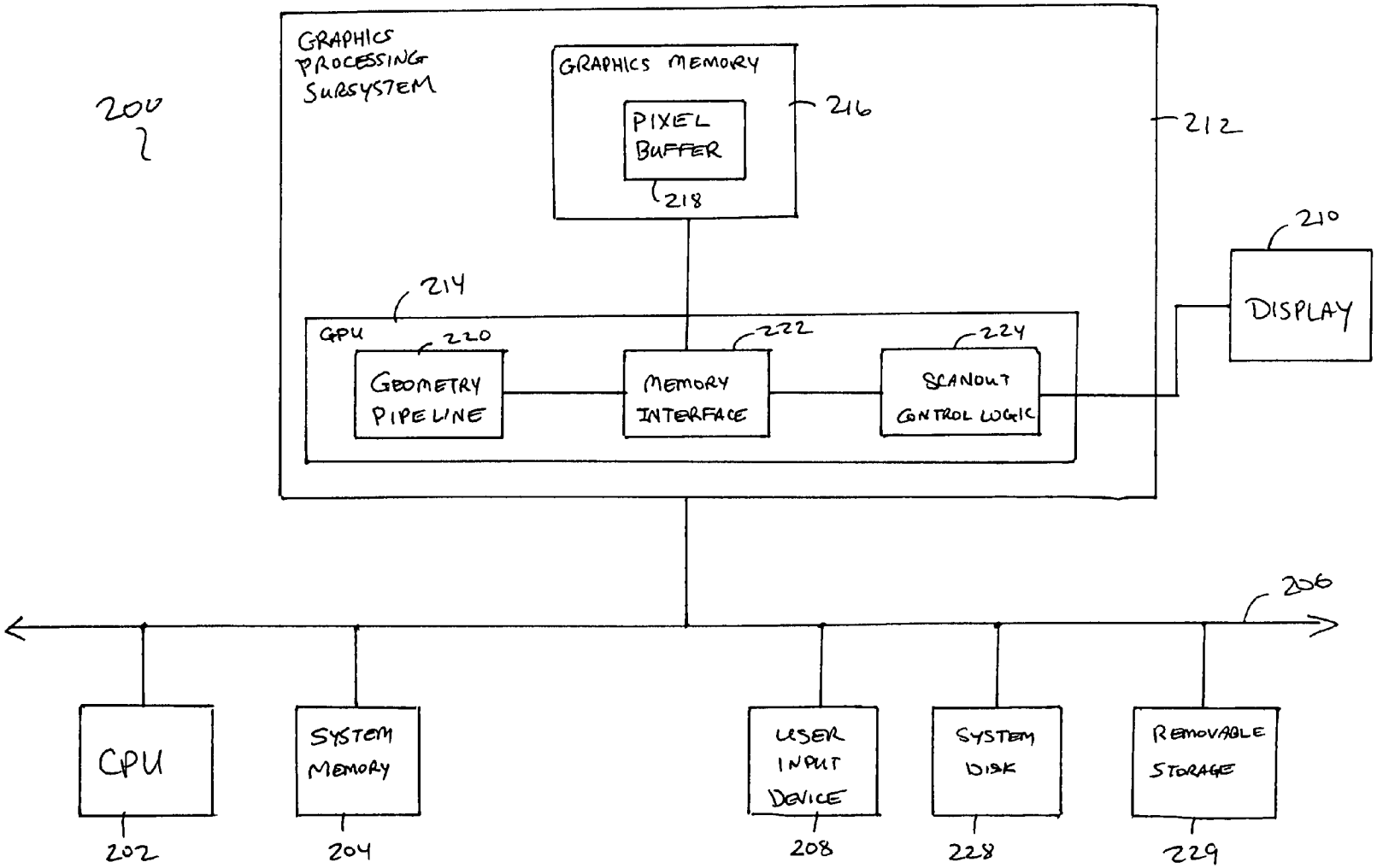
FIG. 2 is a block diagram of a computer system according to an embodiment of the present invention.

FIG. 2 is a block diagram of a computer system 200 according to an embodiment of the present invention. Computer system 200 includes a central processing unit (CPU) 202 and a system memory 204 communicating via a bus 206. User input is received from one or more user input devices 208 (e.g., keyboard, mouse) coupled to bus 206. Visual output is provided on a pixel based display device 210 (e.g., a conventional CRT or LCD based monitor) operating under control of a graphics processing subsystem 212 coupled to system bus 206. A system disk 228 and other components, such as one or more removable storage devices 229 (e.g., floppy disk drive, compact disk (CD) drive, and/or DVD drive), may also be coupled to system bus 206. System bus 206 may be implemented using one or more of various bus protocols including PCI (Peripheral Component Interconnect), AGP (Accelerated Graphics Port) and/or PCI Express (PCI E); appropriate "bridge" chips such as a conventional north bridge and south bridge (not shown) may be provided to interconnect various components and/or buses.

Graphics processing subsystem 212 includes a graphics processing unit (GPU) 214 and a graphics memory 216, which may be implemented, e.g., using one or more integrated circuit devices such as programmable processors, application specific integrated circuits (ASICs), and memory devices. Graphics memory 216 includes a pixel buffer 218 that stores color data for an array of display pixels. GPU 214 includes a geometry processing pipeline 220, a memory interface module 222, and scanout control logic 224. Geometry processing pipeline 220 may be configured to perform various tasks related to generating pixel data from graphics data supplied via system bus 206 (e.g., implementing various 2D and or 3D rendering algorithms), interacting with graphics memory 216 to store and update pixel data, and the like. Memory interface module 222, which communicates with geometry pipeline 220 and scanout control logic 224, manages all interactions with graphics memory 216. Memory interface module 222 may also include pathways for writing pixel data received from system bus 206 to pixel buffer 218 without processing by geometry pipeline 220. The particular configuration of geometry processing pipeline 220 and memory interface module 222 may be varied as desired, and a detailed description is omitted as not being critical to understanding the present invention.

As mentioned above, pixel buffer 218 stores color data for an array of display pixels. In some embodiments, the color data for a pixel includes separate red (R), green (G), and blue (B) color intensity values, each represented using a number (e.g., 8) of bits. Pixel buffer 218 may also store other data, such as depth (Z) and/or transparency data for some or all pixels. In some embodiments, pixel buffer 218 may store more than one set of RGB color values per pixel, and the color values may be combined, or downfiltered, prior to or during scanout operation. It is to be understood that GPU 214 may be operated in any manner that results in pixel data being written to pixel buffer 218.

Scanout control logic 224, which may be integrated in a single chip with GPU 214 or implemented in a separate chip, reads color data from pixel buffer 218 and transfers the data to display device 210 to be displayed. In one embodiment, scanout occurs at a constant screen refresh rate (e.g., 80 Hz); the refresh rate can be a user selectable parameter. Scanout control logic 224 may also perform other operations, such as adjusting color values for particular display hardware; generating composite screen images by combining the pixel data from pixel buffer 218 with data for a video or cursor overlay image or the like obtained, e.g., from graphics memory 216, system memory 204, or another data source (not shown); converting digital pixel data to analog signals for the display device; and so on.

In accordance with an embodiment of the present invention, scanout control logic 224 performs color dithering in the event that the display device has a lower color resolution (e.g., number of allowed values of any or all of the RGB color components) than the color resolution used in pixel buffer 118. This color dithering is advantageously based on an error accumulation technique described in detail below.

It will be appreciated that the system described herein is illustrative and that variations and modifications are possible. A GPU may be implemented using any suitable technologies, e.g., as one or more integrated circuit devices. The GPU may be mounted on an expansion card that may include one or more such processors, mounted directly on a system motherboard, or integrated into a system chipset component (e.g., into the north bridge chip of one commonly used PC system architecture). The graphics processing subsystem may include any amount of dedicated graphics memory (some implementations may have no dedicated graphics memory) and may use system memory and dedicated graphics memory in any combination. In particular, the pixel buffer may be implemented in dedicated graphics memory or system memory as desired. The scanout control logic circuitry may be integrated with a GPU or implemented as a separate chip; scanout logic may be implemented using one or more ASICs, programmable processor elements, or any combination thereof.

Figure 3:
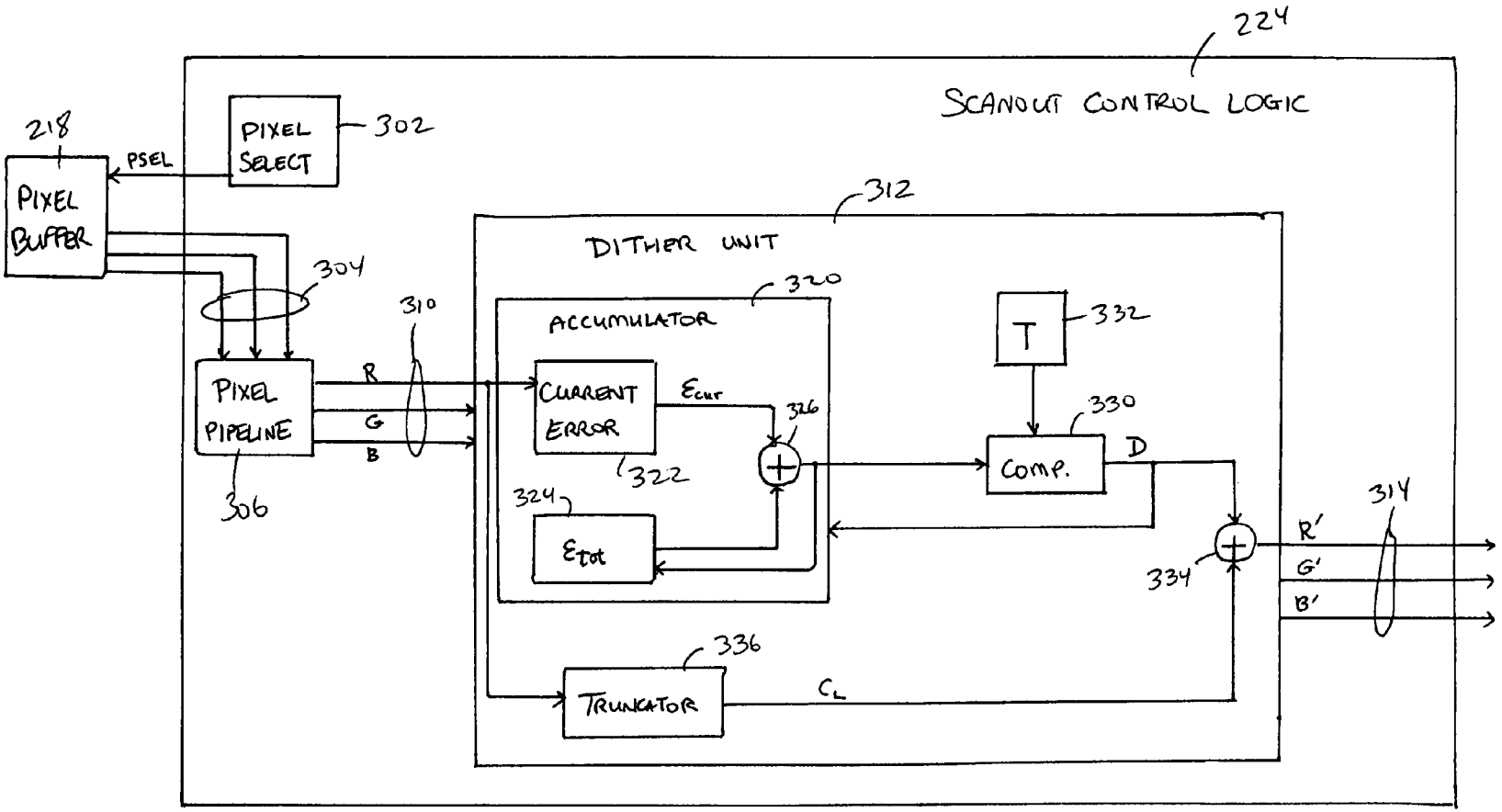
FIG. 3 is a block diagram of scanout control logic according to an embodiment of the present invention.

FIG. 3 is a block diagram showing more detail of scanout control logic 224 according to an embodiment of the present invention. Pixel select block 302, which may be of generally conventional design, selects a current pixel (e.g., by scanning across lines of pixels in a raster array, with the current pixel being incremented according to a pixel clock signal) and generates a pixel select signal (PSEL) for pixel buffer 218. This signal causes the color value for the selected pixel (represented, e.g., as RGB components) to be transmitted to scanout control logic 224 via signal lines 304. Scanout control logic 224 may include a pixel pipeline 306 having one or more stages configured to perform various transformations on the pixels. Numerous examples of such transformations are known in the art, such as composition of images using overlays, resealing of image size, visible area selection, downfiltering, and the like. Any desired transformations may be implemented in pixel pipeline 306, and detailed descriptions are omitted as not being critical to understanding the present invention.

After any transformations in pixel pipeline 306, a final pixel color is provided via signal lines 310 to a dither unit 312. In the embodiment shown in FIG. 3, signal lines 310 carry RGB color component values; it is to be understood that other color representations may be used. The color components are provided at a "high" resolution (e.g., 8 bits per color component in one embodiment), which may be the same resolution at which color data is stored in pixel buffer 218. Dither unit 312 converts each color component to a lower resolution (e.g., 6 bits per component) that is defined for the display device and transmits the low resolution color component values (R', G', B') via signal lines 314 to the display device.

In accordance with an embodiment of the present invention, dither unit 312 implements an error accumulation dithering algorithm. As each pixel is processed, each color component is truncated to the nearest lower intensity color value in the low resolution color space, e.g., by dropping one or more least significant bits (LSBs). The difference ("error") between the target high-resolution color component value and the nearest lower intensity color component value (e.g., the value represented by the dropped LSBs) is accumulated from one pixel to the next. When the accumulated error reaches a certain threshold (e.g., a value corresponding to the number of LSBs that are being dropped), the current pixel's color component is shifted up to the next higher value in the low resolution color space, and the threshold amount is subtracted from the accumulated error before the next pixel is processed.

Figure 4:
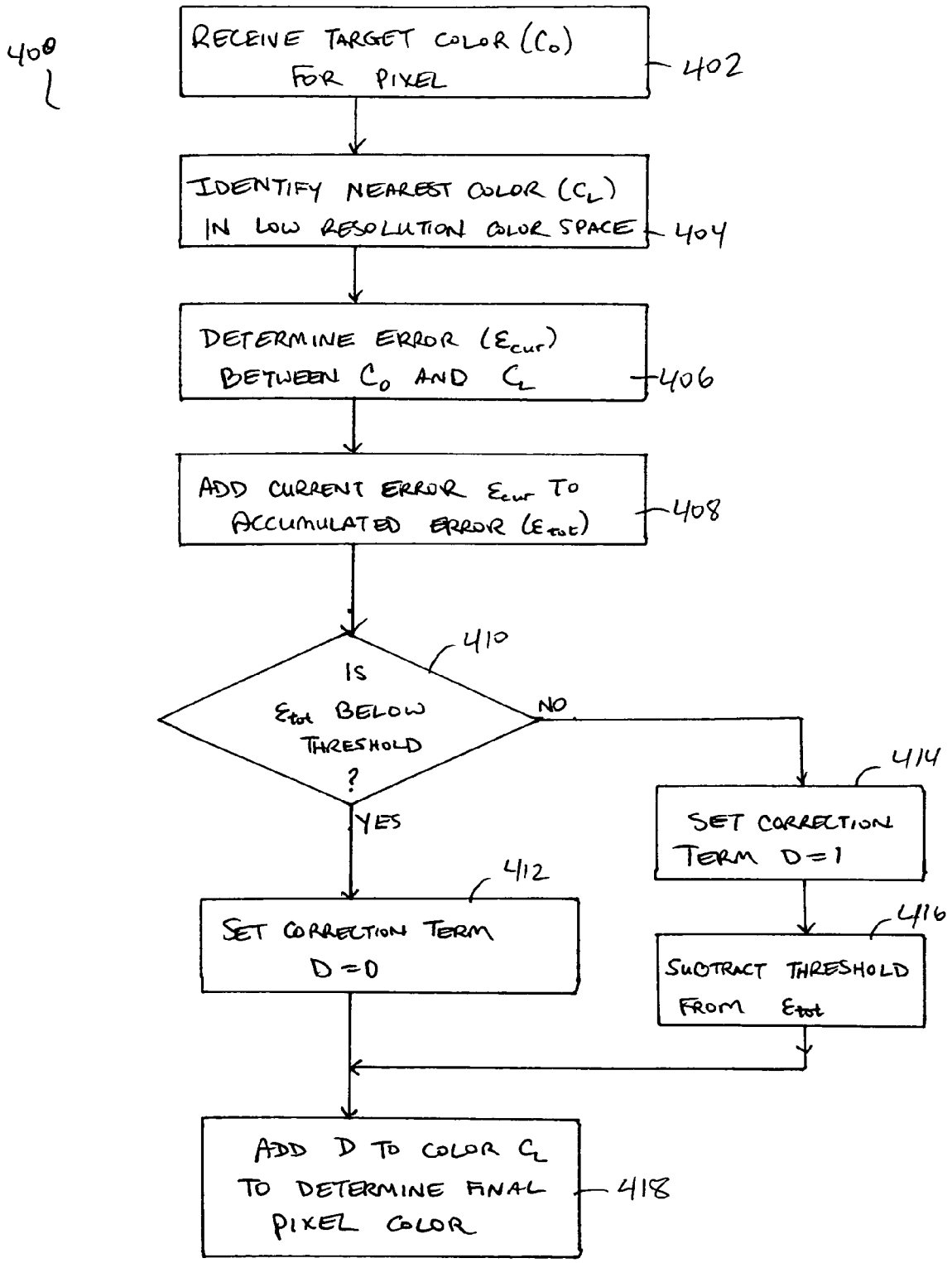
FIG. 4 is a flow diagram of a process for error accumulation dithering according to an embodiment of the present invention.

FIG. 4 is a flow diagram of a process 400 for error accumulation dithering according to an embodiment of the present invention. At step 402, a target color component $C_0$ for a pixel is received as a value in a high-resolution color space. At step 404, the nearest value in the low resolution color space that is below the target value is identified as a low value $C_L$. This may be done, e.g., by truncating or dropping one or more LSBs from the target value $C_0$ or setting one or more LSBs of $C_0$ to zero. At step 406, a current error $\epsilon_{cur}$ is determined, where $\epsilon_{cur}$ corresponds to the difference between the target color $C_0$ and the low value $C_L$. At step 408, the current error $\epsilon_{cur}$ is added to an accumulated error $\epsilon_{tot}$.

At step 410, the accumulated error $\epsilon_{tot}$ is compared to a threshold. This threshold may advantageously be set equal to the number of high resolution colors for which the same low value $C_L$ would be identified at step 404. For instance, if the high resolution color space provides eight bits per component and the low resolution color space provides six bits per component, the threshold may be set to a value of 4. If the accumulated error $\epsilon_{tot}$ is less than the threshold, then a correction term D is set to a value of 0 at step 412. Otherwise, the correction term D is set to a value of 1 at step 414, and the threshold value is subtracted from the accumulated error $\epsilon_{tot}$ at step 416. In either case, at step 418, the final pixel color is determined by adding the correction term D to the low value $C_L$ identified at step 404. Accordingly, if D was set to 0 at step 412, the pixel will be displayed at the color $C_L$ determined at step 404, while if D was set to 1 at step 414, the pixel will be displayed at the next higher color $C_H$ (which corresponds to $C_L$+1 in the low resolution color space).

Accordingly, if higher color values correspond to higher intensity, pixels are displayed at a lower intensity than the target value until the accumulated error reaches the threshold. The pixel for which the error reaches the threshold is displayed at a higher intensity than the target color, and the accumulated error is decremented by the threshold value. Thus, within a region of generally uniform color where target color $C_0$ is intermediate between two low resolution values $C_L$ and $C_H$, the frequency with which the accumulated error reaches the threshold will depend on the magnitude of the difference between the target color and the low value $C_L$.

Accordingly, the fraction of pixels displayed at the high color $C_H$ also depends on that magnitude, so that the desired appearance of an intermediate color can be generated.

It should also be noted that for pixels where the high resolution color $C_0$ exactly matches one of the low resolution values $C_L$, no new error is accumulated because the current error $\epsilon_{cur}$ is zero for such pixels; all such pixels are displayed at the specified color. Any previously accumulated error can simply be carried forward for possible use in dithering later processed pixels.

It will be appreciated that the process described herein is illustrative and that variations and modifications are possible. Steps described as sequential may be executed in parallel, order of steps may be varied, and steps may be modified or combined.

Referring again to FIG. 3, shown within dither unit 312 are various functional blocks related to implementation of process 400 for the R color component. It is to be understood that similar functional blocks may be provided for other (G and B) color components. An accumulator 320 includes a current error block 322, a register 324, and an adder circuit 326. Current error block 322 computes the current error $\epsilon_{cur}$ from the input R color component received on signal lines 310. In one embodiment, current error block 322 extracts a selected number of LSBs from the input signal. The number of LSBs that are extracted may be a configurable parameter and may be determined dynamically based on the difference in color resolution between the pixel buffer and the display. For example, if the pixel buffer stores 8 bits per color component while the display uses only 6 bits per component, the two LSBs would be extracted. Register 324 stores the accumulated error $\epsilon_{tot}$. Adder circuit 326 adds the current error $\epsilon_{cur}$ to the accumulated error $\epsilon_{tot}$ and stores the result back to register 324.

The resulting accumulated error $\epsilon_{tot}$ from adder circuit 326 is also provided as one input to a comparator 330. The other input of comparator 330 is provided by a register 332 that stores a threshold value (T). Threshold value T may be a configurable parameter and may be determined dynamically based on the difference in color resolution between the pixel buffer and the display. For example, for converting from 8 bits per component to 6 bits per component, T=4 may be used. Comparator 330 compares the accumulated error $\epsilon_{tot}$ to the threshold value T and produces a correction signal D. In this embodiment, D=1 signifies that $\epsilon_{tot}$ has reached the threshold value T, and D=0 signifies that it has not. Correction signal D is returned to accumulator 320, which uses the value of D to determine whether to decrement the accumulated error $\epsilon_{tot}$ stored in register 324. Correction signal D is also provided as an input to an adder circuit 334.

Truncator circuit 336 receives the input color signal R from signal lines 310 and converts the color value to the desired low resolution, e.g., by dropping a selected number of LSBs, passing the low resolution signal as an input ($C_L$) to adder circuit 334 In some embodiments, the number of LSBs that are dropped may be a configurable parameter and may be determined dynamically based on the difference in color resolution between the pixel buffer and the display. This number may be set to the same value as the number of LSBs extracted by current error block 322. Truncator circuit 336 may also include additional timing circuitry (not shown) so that the truncated color signal arrives at the input of adder circuit 334 concurrently with the correction signal D from comparator 330.

Adder circuit 334 adds the correction signal D from comparator 330 to the truncated color signal $C_L$ from truncator circuit 336, providing the result as the final color component R' on signal lines 314. Depending on the value of correction signal D, the final color component R' will have a value of either $C_L$ or the next higher value $C_H=C_L+1$.

It will be appreciated that the dither unit described herein is illustrative and that variations and modifications are possible. The various functional blocks and registers may be implemented using conventional integrated circuit technologies. Separate circuitry may be implemented for each color component, or different color components may share circuitry as desired. In addition, color data need not be provided in the RGB format described herein; other formats such as luminance and chrominance may also be used. Different components may be dithered to different resolutions as appropriate. In some embodiments, the dither unit may be configured to be idle in the event that the color resolution of the display is not lower than that of the pixel buffer. In other embodiments, when the pixel buffer and the display have the same color resolution, the dithering operations may be executed with no error bits being extracted from the input signal. Since the error in such a case would remain below the threshold, the operation of the dither unit would have no effect on the color of each pixel.

Variations of the error accumulation dithering algorithm described above may also be used. For example, in one alternative algorithm, the accumulated error from previous pixels is added to the received high resolution color for the current pixel. The resulting high resolution value is then reduced or truncated to the lower resolution (e.g., by dropping LSBs) and the truncated portion is stored as the new accumulated error. As with process 400, this alternative technique can result in pixels being displayed a lower intensity color ($C_L$) until the accumulated error $\epsilon_{tot}$ reaches a sufficient (threshold) size such that $C_0+\epsilon_{tot}\geqq C_H$; at that point, one pixel is displayed at the higher intensity color ($C_H$), and the accumulated error is reduced below the threshold.

Figure 5:
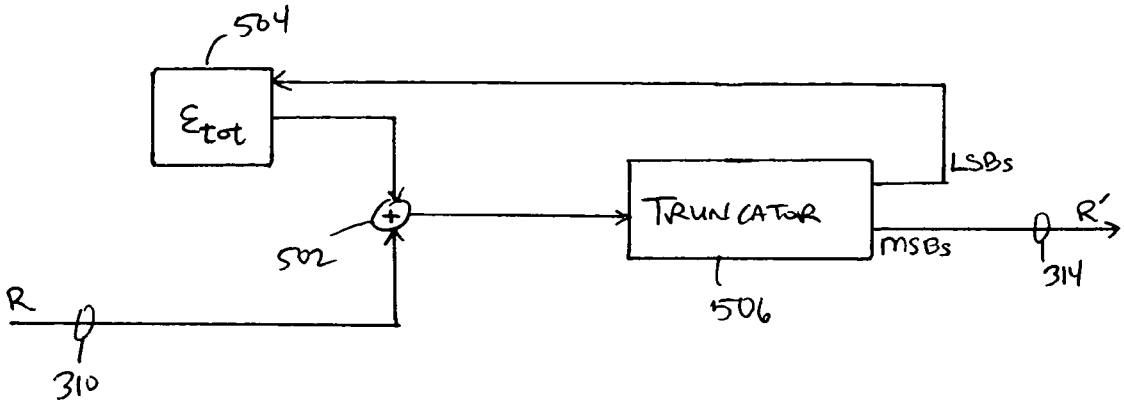
FIG. 5 is a block diagram of a dither unit according to an alternative embodiment of the present invention.

FIG. 5 is a block diagram of a dither unit 500 that implements this algorithm. An input color component (e.g., red component R) is received on input lines 310 at one input of an adder circuit 502. An accumulated error $\epsilon_{tot}$ is stored in a register 504 and provided as the other input to adder circuit 502. The resulting value is provided (at the high resolution) to truncator circuit 506. Truncator circuit 506 provides a number of most significant bits (MSBs) as the low resolution color signal R' on output signal lines 314. The remaining bits (LSBs) are stored in register 504 as a new accumulated error $\epsilon_{tot}$.

As noted above, the dither unit may also be configurable for different output color resolutions. In such embodiments, additional logic may be included for detecting the desired output color resolution and determining a number of bits to be truncated to reduce the input color resolution to the desired output resolution. In the embodiment of FIG. 3, this same number of bits may also be extracted as the current error and used as the basis for setting the threshold value T. For example, if an 8-bit color component is to be reduced to 6 bits, two bits would be truncated by truncator 336, two bits would be extracted as the current error by error determining block 322, and the threshold would be set to 4. If the display conditions later changed so that the 8-bit color component was to be reduced to 5 bits, parameters would be adjusted so that truncator 336 would truncate 3 bits, error determining block 322 would extract three bits, and the threshold value T would be set to 8.

In some embodiments, the accumulated error $\epsilon_{tot}$ is initialized from time to time, e.g., at the beginning of each scan line of pixels during a raster scan. The beginning of a line can be detected, e.g., by detecting a conventional "hsync" or horizontal retrace signal. In one embodiment, the accumulated error $\epsilon_{tot}$ is initialized to the same value (e.g., zero) at the beginning of each line. In another embodiment, the initial value of $\epsilon_{tot}$ for a given line is determined based in part on the line number. For example, some or all of the bits of $\epsilon_{tot}$ can be set equal to selected bits of the line number, so that adjacent scan lines have $\epsilon_{tot}$ initialized to different values. In one such embodiment, the two LSBs of the line number are used to initialize the two MSBs of $\epsilon_{tot}$ that are below the threshold value T, so that the initial value of $\epsilon_{tot}$ cycles between four possible values as successive lines are scanned. (E.g., in an embodiment where 3 bits are truncated, the bits of $\epsilon_{tot}$ in the $2^1$ and $2^2$ positions would be initialized.) In other embodiments, other patterns may be used. Using different initializations for different scan lines can help to break up vertical banding artifacts that may occur in regions of generally uniform color. In other embodiments, the value of $\epsilon_{tot}$ may be carried over from the last pixel of one scan line to the first pixel of the next scan line.

In other embodiments, the initialization value(s) for the accumulated error $\epsilon_{tot}$ may vary from frame to frame. For example, a new frame can be detected, e.g., by detecting a conventional "vsync" or vertical retrace signal. A frame toggle may be provided as a single bit that flips between "0" and "1" states at the start of each new frame. In one embodiment, selected bits of $\epsilon_{tot}$ are initialized based on a logical XOR (exclusive OR) operation using the frame toggle and a selected bit of the line number. Due to the frame toggle, the initial value of $\epsilon_{tot}$ for a given scan line switches between two different values on alternating frames. On a display device with a sufficiently high screen refresh rate (e.g., 70 frames/second), the oscillation can occur fast enough that the human eye does not perceive it except as a further blending of the colors $C_L$ and $C_H$ in a quasi-static image.

In still other embodiments, the accumulated error $\epsilon_{tot}$ may be carried forward from line to line and/or from frame to frame. This can introduce a quasi-randomness (or history dependence) to the colors displayed for pixels of a given image. Where such effects are not desired, $\epsilon_{tot}$ may be initialized from time to time, e.g., as described above.

FIG. 6 illustrates the effect of dithering in accordance with the present invention. FIG. 6A shows an original image consisting of two gradient grayscales. This image is rendered using 24 bit color, and the gradient appears generally smooth to the eye. FIG. 6B shows the same image rendered using 9 bit color (3 bits in each RGB component) without dithering. In this image, the gradient appears as a number of discrete color blocks. FIG. 6 shows the image of FIG. 6A rendered using 9 bit color with conventional matrix-based dithering using a 2×2 dither matrix. While the gradient is smoother than in FIG. 6B, distinct "screen door" patterns are also apparent.

Figure 6A:
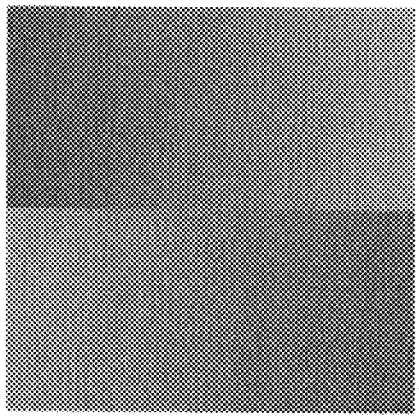
FIGS. 6A-D illustrate the effect of different dithering schemes, with FIG. 6A showing a high-resolution image, FIG. 6B showing the same image rendered at low resolution without dithering, FIG. 6C showing the same image rendered at low resolution with conventional matrix-based dithering, and FIG. 6D showing the same image rendered at low resolution with dithering according to an embodiment of the present invention.
Figure 6B:
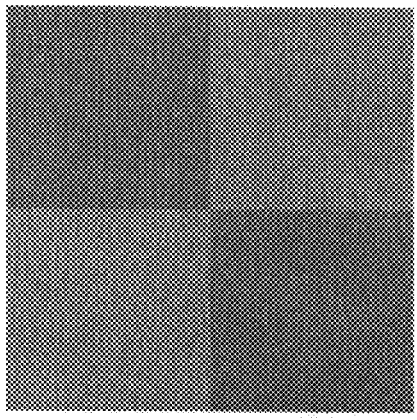
FIG. 6B (Prior Art)
Figure 6C:
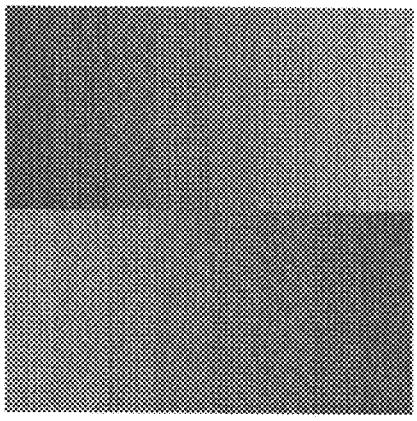
FIG. 6C (Prior Art)
Figure 6D:
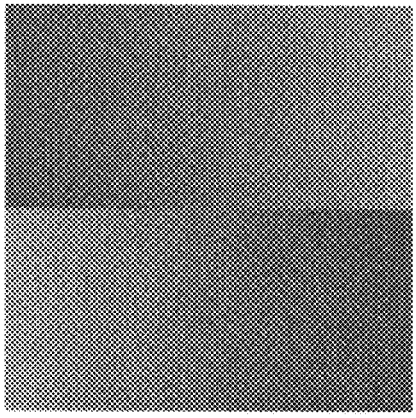

Finally, FIG. 6D shows the image of FIG. 6A rendered using 9 bit color with error accumulation dithering according to an embodiment of the present invention. The gradient appears even smoother than in FIG. 6C, and geometric "screen door" patterns are largely absent. It should be noted that for a typical display device, the patterns of dots visible in some portions of the image can be made less visible by initializing $\epsilon_{tot}$ to a different value on alternating frames as described above.

It is to be understood that the image in FIG. 6D is illustrative and that image quality can be modified, e.g., by varying initialization parameters for the accumulated error $\epsilon_{tot}$, by varying the color resolution for the input and/or output pixel data, and so on.

While the invention has been described with respect to specific embodiments, one skilled in the art will recognize that numerous modifications are possible. For instance, error accumulation dithering may be adapted to color spaces other than RGB spaces, including any color space where it is possible to identify a color (or color component) in the high resolution space as being visually intermediate between two colors (or color components) in the low resolution space. The color space may include one or more components, and the respective resolutions (numbers of defined states or values) for different components may be the same or different in either the low resolution or high resolution space. In addition, colors need not be represented as values on a low-to-high intensity (or dark to light) scale as used herein; the relationship of values to colors may be defined as desired. Further, embodiments of the invention may also be adapted for use with a floating point pixel buffer in which a potentially limitless range of color values can be defined for the high resolution color space. Some embodiments may be configurable to support dithering in different color spaces.

The scanout control logic described herein is also illustrative. In some embodiments, the scanout control logic may be configured to process multiple pixels in parallel at any or all stages, including during dithering. In some embodiments, the final (dithered) color signals may be subject to further processing, such as digital-to-analog conversion and post-conversion filtering, prior to being sent to a display device. In other embodiments, the final color signals are provided in digital form to a display device controllable by digital signals.

Further, while the error accumulation techniques are described herein in the context of implementation during a scanout operation, similar techniques may be implemented at other pixel processing stages or internally to a display device. Dithering may be supported in hardware devices (e.g., circuitry), software executable by one or more suitable processors, and/or any combination thereof.

Thus, although the invention has been described with respect to specific embodiments, it will be appreciated that the invention is intended to cover all modifications and equivalents within the scope of the following claims.

What is claimed is:

1. A method of dithering an image, the method comprising the acts of:

receiving a target color at a high color resolution for a current one of a plurality of pixels of the image, the target color being intermediate between a first color and a second color at a low color resolution;

tracking an accumulated error across the plurality of pixels up to and including the current pixel;

selecting one of the first color and the second color as a final pixel color, wherein the first color is selected in the event that the accumulated error is less than a threshold, wherein the second color is selected in the event that the accumulated error exceeds the threshold, and wherein the accumulated error is reduced below the threshold in the event that the second color is selected;

providing an updated accumulated error to a next one of the plurality of pixels; and outputting the selected final pixel color for display on a display device.

2. The method of claim 1, wherein the act of tracking the accumulated error includes the acts of:

determining a current error based on a difference between the first color and the target color; and adding the current error to the accumulated error.

3. The method of claim 2, further comprising the act of reducing the accumulated error by an amount corresponding to the threshold in the event that the second color is selected.

4. The method of claim 1, wherein the plurality of pixels corresponds to a scan line of a display device.

5. The method of claim 4, further comprising the act of initializing the accumulated error at a beginning of the scan line.

6. The method of claim 5, wherein the accumulated error is initialized to a value that depends at least in part on a line number of the scan line.

7. The method of claim 6, wherein the accumulated error is initialized to a value that is different for successive frames.

8. The method of claim 1, wherein the threshold corresponds to a difference between respective high resolution representations of the first color and the second color.

9. The method of claim 1, wherein the target color is one of a plurality of independent color components for the pixel.

10. A device for dithering an image, the device comprising:

an accumulator module configured to track an accumulated error across a plurality of pixels of the image;

a conversion module configured to receive a high resolution color signal for a current pixel of the image and to generate a corresponding low resolution color signal;

an adjustment module to select between a first color and a second color for the current pixel by modifying the low resolution color signal from the first color to the second color for the current pixel in the event that the accumulated error exceeds a threshold; and an output module configured to output the low resolution color signal for the current pixel for display on a display device, wherein after processing the current pixel, the accumulated error is provided to a next one of the plurality of pixels.

11. The device of claim 10, wherein the accumulator module includes:

a current error circuit configured to extract a current error from the high resolution color signal for the current pixel; and a first adder circuit configured to add the current error to the accumulated error and to provide an updated accumulated error to the adjustment module.

12. The device of claim 11, wherein the adjustment module includes:

a comparator circuit configured to compare the updated accumulated error to a threshold, thereby generating a dither control signal; and a second adder circuit configured to receive the low resolution color signal from the conversion module and to adjust the received low resolution color signal based on the dither control signal, thereby generating a final color signal.

13. The device of claim 12, wherein the comparator circuit is further configured to provide the dither control signal as a feedback signal to the accumulator module, and wherein the accumulator module is further configured to reduce the accumulated error based on the dither control signal.

14. The device of claim 10, wherein the accumulator module includes a register configured to store the accumulated error.

15. The device of claim 10, wherein the adjustment circuit includes an adder circuit configured to add the accumulated error to the high resolution color signal, thereby generating an intermediate color signal.

16. The device of claim 15, wherein the conversion circuit includes a truncator circuit configured to reduce the intermediate color signal to a low resolution color signal.

17. The device of claim 16, wherein the truncator circuit is further configured to reduce the intermediate color signal by removing a number of least significant bits and to store the removed least significant bits in a register as a new accumulated error.

18. A graphics processing unit comprising:

a geometry pipeline unit configured to generate pixel data for an image; and a scanout module configured to provide the pixel data to a display device, wherein the scanout module includes a dithering unit, the dithering unit comprising:

an accumulator module configured to track an accumulated error across a plurality of pixels of the image;

a conversion module configured to receive a high resolution color signal for a current pixel of the image and to generate a corresponding low resolution color signal;

an adjustment module to select between a first color and a second color for the current pixel by modifying the low resolution color signal from the first color to the second color for the current pixel in the event that the accumulated error exceeds a threshold; and an output module configured to output the low resolution color signal for the current pixel for display on the display device.

* * * * *